US008112909B2

(12) United States Patent
Kubo et al.

(10) Patent No.: US 8,112,909 B2
(45) **Date of Patent: *Feb. 14, 2012**

(54) SOLE WITH REINFORCEMENT STRUCTURE

(75) Inventors: Seiji Kubo, Kobe (JP); Kiyomitsu Kurosaki, Kobe (JP); Tsuyoshi Nishiwaki, Kobe (JP)

(73) Assignee: Asics Corporation, Kobe (JP)

( * ) Notice: Subject to any disclaimer, the term of this patent is extended or adjusted under 35 U.S.C. 154(b) by 1024 days.

This patent is subject to a terminal disclaimer.

(21) Appl. No.: 10/562,564

(22) PCT Filed: Oct. 13, 2004

(86) PCT No.: PCT/JP2004/015042

§ 371 (c)(1),
(2), (4) Date: Dec. 27, 2005

(87) PCT Pub. No.: WO2005/037002

PCT Pub. Date: Apr. 28, 2005

(65) Prior Publication Data

US 2006/0137228 A1 Jun. 29, 2006

(30) Foreign Application Priority Data

Oct. 17, 2003 (JP) ..... 2003-357974

(51) Int. Cl.
*A43B 23/00* (2006.01)
*A43B 13/12* (2006.01)

(52) U.S. Cl. ..... 36/107; 36/30 R

(58) Field of Classification Search ..... 36/30 R, 36/107, 108, 145, 148, 152, 154, 166, 181
See application file for complete search history.

(56) References Cited

U.S. PATENT DOCUMENTS

| | | | |
|---|---|---|---|
| 3,834,046 | A | 9/1974 | Fowler |
| 4,012,854 | A | 3/1977 | Berend et al. |
| 4,187,620 | A | 2/1980 | Selner |
| 4,451,994 | A | 6/1984 | Fowler |
| 4,462,171 | A | 7/1984 | Whispell |
| 4,663,865 | A | 5/1987 | Telecemian |
| 4,833,795 | A | 5/1989 | Diaz |
| 5,046,267 | A | 9/1991 | Kilgore et al. |
| 5,220,737 | A | 6/1993 | Edington |
| 5,311,674 | A | 5/1994 | Santiyanont et al. |
| 5,331,750 | A | 7/1994 | Sasaki |

(Continued)

FOREIGN PATENT DOCUMENTS

DE 7932020 U1 4/1980

(Continued)

*Primary Examiner* — Jila Mohandesi
*Assistant Examiner* — Sharon M Prange
(74) *Attorney, Agent, or Firm* — Mintz Levin Cohn Ferris Glovsky and Popeo, P.C.

(57) ABSTRACT

This invention relates to a shoe sole that solves the problems on weight saving in shoes, prevention of distortion, improvement in the fitting property and prevention of upthrust simultaneously. The reinforcing member 3 for reinforcing a part of the midsole 2 is arranged so that the top surface 36 of the second arch 3*c* and the bottom surface 29 of the first arch 2*c* are opposite to each other. At least a part of the bottom surface 29 of the first arch is not in contact with a part of the top surface 36 of the second arch in vertically spaced relationship to each other, thereby that the non-contact areas of the first arch 2*c* and the second arch 3*c* can be deformed independently from each other when impact load of landing is applied.

19 Claims, 12 Drawing Sheets

U.S. PATENT DOCUMENTS

| | | | | |
|---|---|---|---|---|
| 5,894,683 | A | 4/1999 | Lin | |
| 5,937,544 | A | 8/1999 | Russell | |
| 6,076,282 | A | 6/2000 | Brue | |
| 6,092,308 | A | 7/2000 | Srourian | |
| 6,101,743 | A | 8/2000 | Brown | |
| 6,195,915 | B1 | 3/2001 | Russell | |
| 6,199,302 | B1 | 3/2001 | Kayano | |
| 6,212,795 | B1 | 4/2001 | Nakabe et al. | |
| 6,321,469 | B1 | 11/2001 | Cretinon | |
| 6,327,795 | B1 | 12/2001 | Russell | |
| 6,330,757 | B1 | 12/2001 | Russell | |
| 6,467,197 | B1 | 10/2002 | Mitsui et al. | |
| 6,516,539 | B2 | 2/2003 | Nishiwaki et al. | |
| 6,601,321 | B1 | 8/2003 | Kendall | |
| 6,625,905 | B2 * | 9/2003 | Kita | 36/30 R |
| 6,647,646 | B2 | 11/2003 | Mitsui et al. | |
| 6,662,469 | B2 | 12/2003 | Urie et al. | |
| 6,665,959 | B1 | 12/2003 | Vindriis | |
| 6,685,011 | B2 | 2/2004 | Nishiwaki et al. | |
| 6,763,615 | B2 | 7/2004 | Mitsui et al. | |
| 6,854,199 | B2 * | 2/2005 | Polifroni | 36/44 |
| 7,370,443 | B2 * | 5/2008 | Gibert et al. | 36/103 |
| 2001/0005946 | A1 | 7/2001 | Brown | |
| 2001/0010129 | A1 | 8/2001 | Russell | |
| 2001/0052194 | A1 | 12/2001 | Nishiwaki et al. | |
| 2002/0023374 | A1 | 2/2002 | Russell | |
| 2002/0144428 | A1 | 10/2002 | Hay | |
| 2002/0157280 | A1 | 10/2002 | Russell | |
| 2003/0000109 | A1 | 1/2003 | Kita | |
| 2003/0005600 | A1 * | 1/2003 | Kita | 36/76 R |
| 2003/0009912 | A1 | 1/2003 | Stubblefield et al. | |
| 2003/0009914 | A1 | 1/2003 | Mitsui et al. | |
| 2003/0014881 | A1 | 1/2003 | Hay | |
| 2003/0024134 | A1 | 2/2003 | Howlett | |
| 2003/0061733 | A1 | 4/2003 | Karsten | |
| 2003/0079373 | A1 | 5/2003 | Geer et al. | |
| 2003/0079374 | A1 | 5/2003 | Belley et al. | |
| 2003/0101620 | A1 | 6/2003 | Reed et al. | |
| 2004/0006891 | A1 | 1/2004 | Russell | |
| 2004/0025375 | A1 | 2/2004 | Turner et al. | |
| 2004/0031170 | A1 | 2/2004 | Chi | |
| 2004/0068893 | A1 | 4/2004 | Kendall | |
| 2004/0079000 | A1 | 4/2004 | Mitsui et al. | |

FOREIGN PATENT DOCUMENTS

| | | | |
|---|---|---|---|
| DE | 3027601 | A1 | 2/1982 |
| DE | 19953146 | A1 | 5/2000 |
| EP | 0 838 169 | A2 | 4/1998 |
| GB | 2317812 | | 4/1998 |
| JP | 02-017002 | A | 1/1990 |
| JP | 07-034703 | | 6/1995 |
| JP | 07-044268 | | 11/1995 |
| JP | 10-155508 | A | 6/1998 |
| JP | 10-155511 | | 6/1998 |
| JP | 10-248609 | | 9/1998 |
| JP | 2000-139508 | | 5/2000 |
| JP | 3070442 | | 5/2000 |
| JP | 2000-333705 | | 12/2000 |
| JP | 2003-9906 | | 1/2003 |
| JP | 2003-019004 | | 1/2003 |
| WO | WO 93/18677 | | 9/1993 |

* cited by examiner

FIG. 10 (a) PRIOR ART
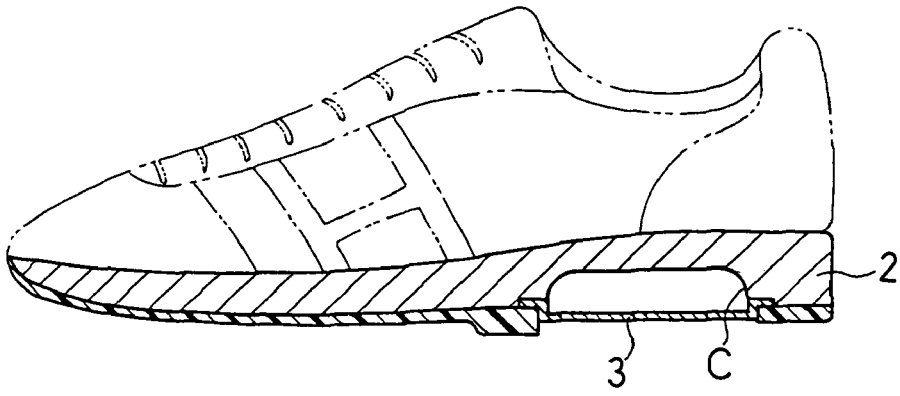
FIG. 10 (b) PRIOR ART
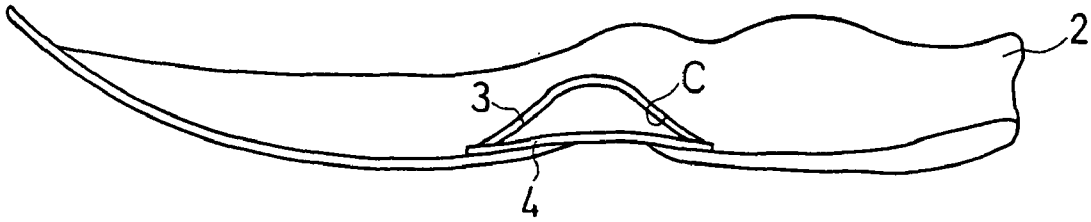
FIG. 10 (c) PRIOR ART
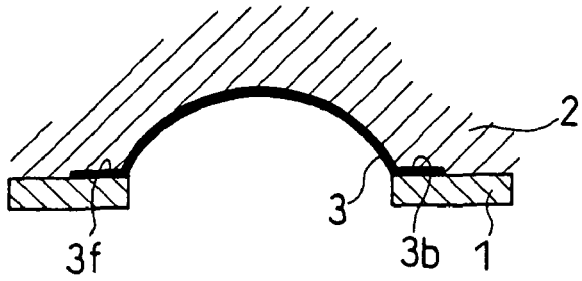

SOLE WITH REINFORCEMENT STRUCTURE

TECHNICAL FIELD

The present invention relates to a shoe sole with a reinforcing structure having a so-called shank (reinforcing member).

BACKGROUND ART

A shoe sole that has a reinforcing member conforming to the shape of the arch of the midsole in the arch portion, for example, a shoe sole in which a portion of the midsole not attached to the outer sole does not have ground contact when the outer sole is grounded, is known. Such a reinforcing structure increases the rigidity of the arch portion of the midsole by suppressing deformation of the midsole. Examples of such known structures are shown in FIG. 9(*a*), FIG. 9(*b*), FIG. 10(*a*), FIG. 10(*b*) and FIG. 10(*c*).

FIG. 9(*a*) is a side view of a shoe sole disclosed in Japanese Patent Laid Open No. 10-155511 (Abstract, therein) (publication date: Jun. 16, 1998). This shoe sole is provided with a supporting member 3 for supporting deformation of the arch of the foot on the top surface of a midsole 2. A space R is provided between the supporting member 3 and the midsole 2.

FIG. 9(*b*) is a bottom view of a shoe sole disclosed in Japanese Utility Model Registration Publication No. 3070442 (FIG. 2, therein) (registration date: May 10, 2000). This shoe sole has, a shock-absorbing member 3 composed of a sealed container attached to the bottom surface of the midsole 2. The shock-absorbing member 3 functions as a so-called shank and maintains the shape of the shoe sole.

FIG. 10(*a*) is a sectional view of a shoe sole disclosed in Japanese Utility Model Laid Open No. 7-44268 (Abstract, therein) (publication date: Nov. 14, 1995). In this shoe sole, a concave part C is formed at the rear foot part of the midsole 2. The concave part C is provided with a reinforcing piece 3 for preventing deformation of the rear foot part.

FIG. 10(*b*) is a side view of a shoe sole disclosed in Japanese Patent Laid Open No. 2003-19004 (FIG. 5, therein) (publication date: Jan. 21, 2003). In this shoe sole, an arch C is formed at the bottom of an arch portion of the midsole 2. A first reinforcing member 3 is attached to the bottom surface of the arch C and a second reinforcing member 4 is provided below the first reinforcing member 3.

FIG. 10(*c*) is a side view of a shoe sole disclosed in Japanese Patent Laid Open No. 2000-139508 (Abstract, therein) (publication date: May 23, 2000). In this shoe sole, end portions 3*f* and 3*b*, located forward and backward of a reinforcing member 3 on the bottom surface of a midsole 2, are wedged between the midsole 2 and an outer sole 1. This prevents the depression of the arch of the midsole 2.

The first patent document: Japanese Patent Laid Open No. 10-155511 (abstract)

The second patent document: Japanese Utility Model Registration Publication No. 3070442 (FIG. 2)

The third patent document: Japanese Utility Model Laid Open No. 7-44268 (abstract)

The fourth patent document: Japanese Patent Laid Open No. 2003-19004 (FIG. 5)

The fifth patent document: Japanese Patent Laid Open No. 2000-139508 (abstract)

DISCLOSURE OF THE INVENTION

More generally, in known structures, a reinforcing structure is provided to a shoe sole at a position located in the arch of the foot. Such a structure decreases the weight in the shoe sole, in particular, the middle foot part, and prevents distortion of the shoe sole.

However, such a structure often creates a midsole arch that is too stiff for the wearer and which is hard to fit to the arch of the wearer's foot. In other words, the fitting properties of a shoe sole having such a structure is lowered.

Further, as a part of the top surface of the arch of the midsole forcefully contacts the arch of the foot sole, especially at the time of landing, the wearer feels a so-called "upthrust". That is, the wearer feels the foot sole being thrust upward or being pushed up from below.

None of the aforedescribed art provides a shoe sole that is light in weight, prevents distortion, has improved fitting properties and prevents the described-upthrust. That is, the art disclosed in each of the patent documents cannot solve simultaneously the problems of weight saving, prevention of the distortion, improvement in the fitting properties and prevention of the upthrust.

It is thus an object of the present invention to provide a shoe sole that is light in weight, prevents distortion, has improved fitting properties and prevents the upthrust.

In order to achieve the foregoing object, a shoe sole is provided that has a novel reinforcing structure.

The shoe sole, according to an aspect of the present invention, comprises an outer sole, a midsole attached to a top surface of the outer sole and a reinforcing member for reinforcing a part of the midsole.

The midsole has a middle foot part. The midsole is formed of resin foam and has a first arch at a bottom portion of the middle foot part. The first arch has a bottom surface. The outer sole is substantially not attached to the first arch of the midsole.

The reinforcing member has a second arch, a fore end part located in front of the second arch and a rear end part located in the rear of the second arch. The second arch has a top surface and a bottom surface. The fore end part of the reinforcing member is bonded to at least either the midsole or the outer sole, in front of the first arch. The rear end part of the reinforcing member is bonded to at least either the midsole or the outer sole, in the rear of the first arch.

Young's modulus of the reinforcing member is set to be greater than that of the first arch of the midsole. A member having a greater Young's modulus than the first arch is substantially not affixed to the bottom surface of the first arch.

The bottom surface of the first arch may have a first curved surface which is a concave surface recessed upwards, if necessary, and the top surface of the second arch may have a second curved surface which is convex upwards.

The reinforcing member is arranged so that the top surface of the second arch and the bottom surface of the first arch are opposite each other. At least a part of the bottom surface of the first arch of the midsole is in vertically spaced relationship with at least a part of the top surface of the second arch of the reinforcing member and not in contact therewith. That is, at least a part of the bottom surface of the first arch of the midsole is in vertically spaced relationship with the reinforcing member and not in contact therewith, and further at least a part of the top surface of the second arch of the reinforcing member is in vertically spaced relationship with the midsole and not in contact therewith. Such arrangement of the midsole and the reinforcing member defines a non-contact area of the first arch and a non-contact area of the second arch.

This allows the non-contact areas of the first arch and the second arch to be deformed independently from each other when impact load of landing is applied.

In the present invention, by the use of the description "the outer sole is substantially not attached to the first arch", it is meant to include the case wherein the outer sole is not attached to any portion of the first arch of the midsole and the case wherein the function of the first arch of the present invention is not impaired even if the outer sole is attached to a portion or part of the first arch (for example, the case where the outer sole is attached only to a rim of the first arch).

According to another aspect of the invention, a shoe sole comprises an outer sole having a ground contact surface and a top surface opposite to the ground contact surface, a midsole having a top surface and a bottom surface, the bottom surface being attached to the top surface of the outer sole and covering the top surface of the outer sole, and a reinforcing member for reinforcing a part of the midsole.

In the present invention, by the use of the description "the bottom surface of the midsole is attached to the top surface of the outer sole", it is meant to include the case wherein the bottom surface of the midsole is directly attached to the top surface of the outer sole and the case wherein the bottom surface of the midsole is indirectly attached to the top surface of the outer sole with other member(s) interposed between the midsole and the outer sole.

The midsole has a first arch covered with a middle foot part of a foot. The first arch is formed of resin foam and has a bottom surface. The reinforcing member has a second arch, a fore end part located in front of the second arch and a rear end part located in the rear of the second arch. The second arch has a top surface and a bottom surface. The second arch is located so as to be covered with the first arch. The fore end part of the reinforcing member is bonded to at least either the midsole or the outer sole in front of the first arch. The rear end part of the reinforcing member is bonded to at least either the midsole or the outer sole in the rear of the first arch.

The first arch and the second arch are substantially not attached to the top surface of the outer sole and do not have ground contact when the ground contact surface of the outer sole is grounded. Young's modulus of the second arch is set to be greater than that of the first arch. Such member having a greater Young's modulus than the first arch of the midsole, is substantially not affixed to the bottom surface of the first arch.

The bottom surface of the first arch may have a first curved surface which is a concave surface recessed upward, if necessary, and the top surface of the second arch may have a second curved surface which is convex upwards, if necessary.

The reinforcing member is arranged so that the top surface of the second arch and the bottom surface of the first arch are opposite to each other. At least a part of the bottom surface of the first arch is not in contact with a part of the top surface of the second arch in vertically spaced relationship to each other, thereby to make non-contact areas of the first arch and the second arch defined.

Such a structure allows the non-contact areas to be deformed independently from each other when an impact load of landing is applied.

In the shoe sole of the present invention, when the foot lands on the ground, the impact load at landing is transmitted from the ground contact surface to the sole of the foot via the midsole. At this landing, the first arch of the midsole and the second arch of the reinforcing member, respectively, become deformed. The non-contact areas of both arches deform independently from each other.

The first arch of the midsole is formed of resin foam and has a smaller Young's modulus than the reinforcing member. The Young's modulus of the first arch is set at a value that wearers feel that the first arch is soft.

Since the midsole has the first arch covered with the middle foot part (the arch) of the foot, the bottom portion of the midsole is hollowed out, thus minimizing the thickness of the arch portion of the midsole.

In this manner, since the part of the midsole, which is covered with the middle foot part of the foot is soft and relatively thin, the midsole can easily conform to the shape of arch of the foot.

In the present invention, by the use of the description "have the first arch which is covered with the middle foot part", it is meant to include the case where the first arch is formed so that the center line of the first arch in the longitudinal direction coincides with or comes in proximity of the center line of the arch of the foot in the longitudinal direction. It is preferable that the center lines of the first arch and the second arch are arranged at least just under the navicular bone, the cuboid bone or the cuneiform bone of the foot.

Furthermore, as the first arch is in vertically spaced relationship to the second arch and not in contact with the second arch (the first arch and the second arch face opposite each other and are vertically spaced from each other so that the first arch is not in contact with the second arch), the first arch of the midsole can sink down sufficiently at the non-contact area when the foot lands on the ground, thereby to suppress "upthrust".

A member having a greater Young's modulus than the first arch is substantially not affixed to the bottom surface of the first arch. As a result, the flexibility of the first arch is maintained, and the fitting property of the shoe sole with respect to the arch of the foot and the function of suppressing "upthrust" are not unnecessarily impaired.

In the present invention, by the use of the description "a member having a greater Young's modulus than the first arch is substantially not affixed", it is meant that a member having a greater Young's modulus than the first arch is not affixed (laminated and fixed) onto the bottom surface of the first arch or that the bottom surface of the first arch can have a greater deformation than the top surface of the second arch at landing even if such member is affixed. For example, in the case where the above-mentioned member having a greater Young's modulus is affixed only to a part of the bottom surface of the first arch, or in the case where the above-mentioned member having a greater Young's modulus, affixed to the bottom surface of the first arch, is very thin (for example, 0.5 mm or less, preferably 0.2 mm or less, more preferably 0.1 mm or less), the above-mentioned member having a greater Young's modulus is substantially not affixed. Moreover, the present invention also includes the case where the above-mentioned member having a greater Young's modulus is not affixed to the bottom surface of the first arch even if a member having a smaller Young's modulus than the first arch is affixed to the bottom surface of the first arch, and the case where a coating is merely applied to the bottom surface of the first arch.

In the present invention, it is preferred that a member having a greater Young's modulus than the second arch is substantially not affixed to the bottom surface of the first arch. By the use of the description "a member having a greater Young's modulus than the second arch is substantially not affixed", it is meant to include, for example, the case wherein no member is affixed (laminate and fixed) onto the bottom surface of the first arch and the case wherein a coating is merely applied to the bottom surface of the first arch. Further, for example, in the case wherein a member having a greater Young's modulus than the second arch is not affixed to the bottom surface of the first arch even if a member having a smaller Young's modulus is affixed to the bottom surface of the first arch, and in the case wherein a member which is thicker than the second arch is not affixed to the bottom surface of the first arch even if a film-like member which is thinner than the second arch is laminated and fixed onto the bottom surface of the first arch, the above mentioned member having a greater Young's modulus than the second arch is substantially not affixed to the bottom surface of the first arch. The Young's modulus of the film-like member may be set smaller than that of the second arch, the same as that of the second arch, or greater than that of the second arch. The thickness of the film-like member may be set, for example, 0.5 mm or less, preferably 0.2 mm or less, more preferably 0.1 mm or less.

Generally, the foam and the reinforcing member are not manufactured on the basis of the Young's modulus but are manufactured based on hardness. For example, the hardness of the foam forming the first arch is set within the range of SRIS-C hardness (a value measured by a C-type hardness meter of Society of Rubber Industry, Japan Standard) of about 30 degrees to 80 degrees. On the other hand, the hardness of the reinforcing member forming the second arch is set within the range of JIS-A hardness of about 70 degrees to 100 degrees. JIS-A hardness is a value obtained by measuring with a JIS-A type hardness meter in conformity with JIS K6301.

As the first arch is formed on the midsole, the midsole is hollowed out at the area where the first arch is formed, thereby to realize weight saving of the midsole.

Meanwhile, the hollowed area of the midsole is reinforced by the reinforcing member, thereby to increase strength of the shoe sole against distortion.

Further, the bottom surface of the first arch and the top surface of the second arch are located so as to be opposed to each other. That is, the bottom surface of the first arch and the top surface of the second arch face opposite each other. This heightens the effect of reinforcing the part which improves the fitting property with respect to the foot.

In the present invention, "arch of a foot" means the crescent-shaped recessed area in the middle foot part of a foot. On the other hand, the "arch" shape of the midsole and the reinforcing members broadly encompasses any gate shape, including but not limited to a circular arc shape or a bow shape.

That is, the second "arch" of the reinforcing member means the shape in which a hollow is formed continuously from the medial side of the foot to the lateral side of the foot under the second "arch" of the reinforcing member, and the first "arch" of the midsole means the shape in which a hollow is formed continuously from the medial side of the foot to the lateral side of the foot under the first "arch" unless the reinforcing member is attached. Accordingly, under the second "arch" of the reinforcing member, something can go through from the medial side of the foot to the lateral side of the foot. And, unless the reinforcing member is attached, under the first "arch" of the midsole, something can go through from the medial side of the foot to the lateral side of the foot.

It is preferred that the top surface of the first arch of the midsole is curved so as to be convex upwards approximately along the arch of the sole of the foot and that the bottom surface of the first arch is recessed upwards to form a passage under the first arch. It is preferred that the top surface of the second arch of the reinforcing member faces opposite to the bottom surface of the first arch and that the bottom surface of the second arch has a curved surface recessed upwards. The second arch of the reinforcing member reinforces the first arch of the midsole.

In the present invention, the bottom surface of the first arch may have the first curved surface which is concave in a circular arc shape, if necessary, and the top surface of the second arch may have the second curved surface which is convex upward in a circular arc shape.

As the second arch has the second curved surface which is convex upward, when an external force is applied to the reinforcing member, uniform stress distribution (dispersion of the stress) is realized. As a result, even a thin reinforcing member can provide a great rigidity or strength.

The first curved surface and the second curved surface may be provided in the area of the midsole or the reinforcing member covered with the middle foot part of the foot, in only a portion of the width of the foot. Such curved surfaces need not cover the full width of the foot in the area of the midsole or the reinforcing member covered with the arch of the foot.

The second arch may be formed only in at least a part of the reinforcing member and need not be formed over the full width of the reinforcing member.

The second arch optionally may only cover a portion of the width of the arch of the foot and optionally may be located on only a portion of the arch of the foot, e.g., medial or lateral side.

Moreover, the reinforcing member may be provided only on at least a part of the area of the midsole covered with the middle foot part of the foot, and for example, may be provided on the medial side and/or the lateral side, or part of middle of the foot.

BRIEF DESCRIPTION OF THE DRAWINGS

FIG. 10(*a*), FIG. 10(*b*) and FIG. 10(*c*) each illustrate other known shoe sole, with FIG. 10(*a*) being a longitudinal sectional view of one known shoe sole, FIG. 10(*b*) being a side view of another known shoe sole and FIG. 10(*c*) being a longitudinal sectional view of yet another known shoe sole.

EXPLANATIONS OF LETTERS OR NUMERALS

Figure 1A:
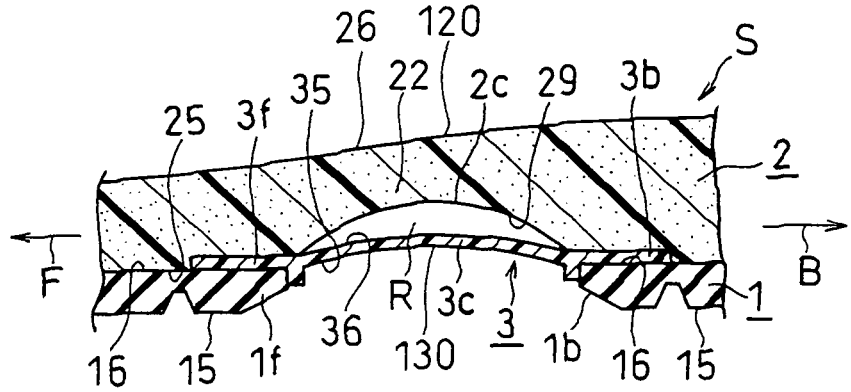
FIG. 1(*a*) and FIG. 1(*b*) are longitudinal sectional views of the shoe sole according to a first embodiment, and FIG. 1(*c*) and FIG. 1(*d*) are longitudinal sectional views of modified examples of the same shoe sole embodiment.
Figure 1B:
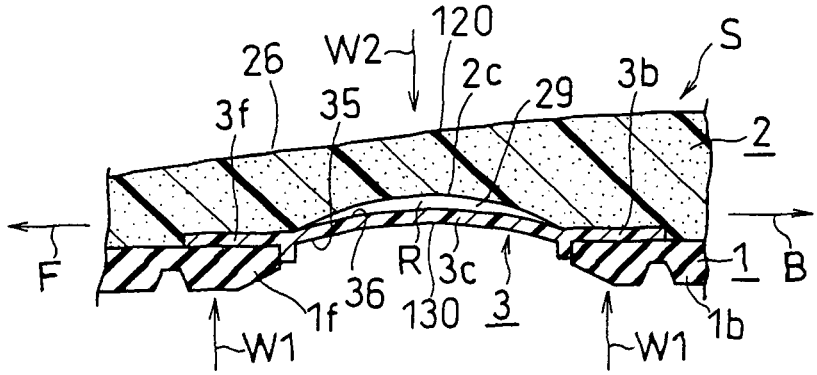
Figure 1C:
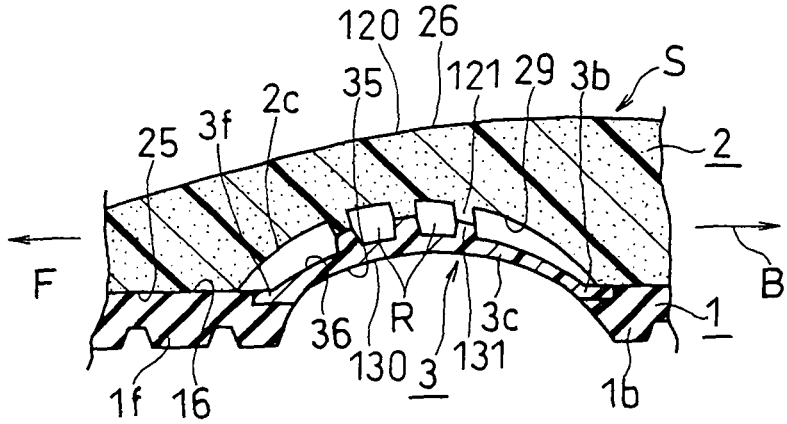
Figure 1D:
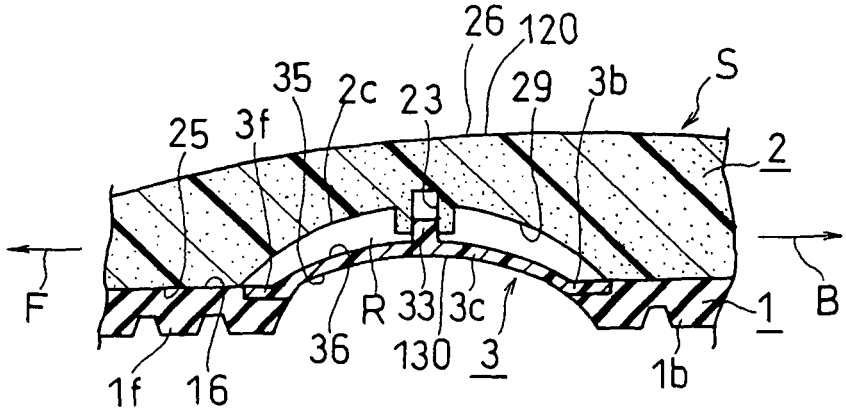

1: Outer sole
15: Ground contact surface
16: Top surface of the outer sole
1*f*: Fore foot part
1*b*: Rear foot part
2: Midsole
25: Bottom surface of the midsole
26: Top surface of the midsole
2*c*: First arch
29: Bottom surface of the first arch
3: Reinforcing member
3*c*: Second arch
3*f*: Fore end part
3*b*: Rear end part
35: Bottom surface of the second arch
36: Top surface of the second arch
37: Peripheral edge
38: Opening
39: First reinforcing member
40: Second reinforcing member
62: First curved surface
63: Second curved surface

BEST MODE FOR CARRYING OUT THE INVENTION

The present invention will be understood more apparently from the following description of preferred embodiments when taken in conjunction with the accompanying drawings. However, it will be appreciated that the embodiments and the drawings are given for the purpose of mere illustration and explanation and that the scope of the present invention is to be defined by the appended claims. In the drawings annexed, the same reference numerals denote the same or corresponding parts throughout several views.

First Embodiment

Hereinafter, a first embodiment of the invention will be described with reference to the drawings. In this first embodiment, the principle embodiment is shown and the basic structure and principle of this invention will be described.

FIG. 1(*a*) and FIG. 1(*b*) are schematic sectional views of a shoe sole S in the middle foot part, i.e., arch region of the foot. The arrow F is the direction toward the front of the shoe and the arrow B is the direction toward the rear or back of the shoe.

As shown in FIG. 1(*a*), the shoe sole S comprises an outer sole 1, a midsole 2 and a reinforcing member 3 for reinforcing the midsole 2.

The outer sole 1 is divided at just under the arch of the foot into a fore foot part 1*f* and a rear foot part 1*b*. Each part 1*f*, 1*b* of the outer sole 1 has a ground contact surface 15 which has ground contact at the time of landing, and a top surface 16 opposite to the ground contact surface 15.

As shown in FIG. 1(*a*), the midsole has a top surface 26 and a bottom surface 25. A part of the bottom surface 25 of the midsole 2 is attached to the top surface 16 of the outer sole 1 so as to cover the outer sole 1 from above. At a bottom portion 22 of this midsole 2, a first arch 2*c* is formed just under the arch of the foot. The first arch 2*c* is formed by hollowing out the bottom surface 25 of the midsole 2 in an arch shape to thus form a concave bottom surface 29 in the first arch 2*c*.

The top surface of the first arch 2*c* has a third curve surface 120 which is curved convex upwards so as to be approximately along the arch of the foot. The third curved surface 120 is gently curved in the central region in the widthwise direction and is largely curved in the medial region.

The reinforcing member 3 has a second arch 3*c*, a fore end part 3*f* in front of the second arch 3*c* and a rear end part 3*b* in the rear of the second arch 3*c*. As shown in FIG. 1(*a*), the second arch 3*c* is formed to bulge upwards. A top surface 36 of the second arch 3*c* is a curved face which is convex upwards, the bottom surface 35 of the second arch 3*c* being a curved face which is concave downwards. That is, the bottom surface 35 of the second arch 3*c* has a fourth curved surface 130 which is recessed upwards. The reinforcing member 3 is arranged so that the second arch 3*c* is covered with the first arch 2*c* from above.

The reinforcing member 3 is supported with its fore and rear end parts 3*f*, 3*b* sandwiched in between the outer sole 1 and the midsole 2. That is, as shown in FIG. 1(*a*), the fore end part 3*f* is sandwiched in between the top surface 16 of the fore foot part 1*f* of the outer sole 1 and the bottom surface 25 of the midsole 2 and the rear end part 3*b* is sandwiched in between the top surface 16 of the rear foot part 1*b* of the outer sole 1 and the bottom surface 25 of the midsole 2 so that the reinforcing member is supported.

This reinforcing member 3 maintains the strength of the shoe sole S at the position corresponding the first arch 3*c* and prevents distortion of the shoe sole S. Accordingly, the Young's modulus of the reinforcing member is set to be larger than that of the first arch 2*c* of the midsole 2.

As shown in FIG. 1(*a*), the top surface 36 of the second arch 3*c* and the bottom surface 29 of the first arch 2*c* of the midsole 2 are arranged so as to be opposite to each other. Thus, the top surface 36 of the second arch 3*c* and the bottom surface 29 of the first arch 2*c* are vertically spaced from each other so that they are not in contact with each other. These surfaces 36, 29 are not in contact with each other and define a domain R, which is hollow.

As shown in FIG. 1(*b*), when the foot lands on the ground, impact load W1 is applied to the ground contact surface 15 of the outer sole 1 of the shoe sole S. At this time, an impact load W1 is transmitted to the sole of the foot via the outer sole 1 and the midsole 2. Simultaneously, a load W2 from the sole of the foot (from above) is applied to the midsole 2. Due to the load W2 from above, the midsole 2 is compressed and sinks down.

At this time, since the first arch 2*c* is placed so as to be spaced from the second arch 3*c* of the reinforcing member 3, the bottom surface 29 of the first arch 2*c* and the top surface 36 of the second arch 3*c* deform independently from each other. That is, the sinkage (deflection) of the bottom surface 29 of the first arch 2*c* is not impeded by the reinforcing member 3. Because of this sinkage (deflection) of the midsole 2, the fitting property of the midsole 2 with respect to the sole of the foot is improved and the "upthrust" at the time of landing of the foot is decreased or suppressed.

In this case, it is preferred that, when the impact load of landing is applied, downward displacement of the non-contact area of the bottom surface 29 of the first arch 2*c* is set larger than downward displacement of the non-contact area of the top surface 36. Such setting allows thrust-up feeling from below to be reduced more.

On the other hand, the reinforcing member 3 is difficult to deform due to its curved shape and the Young's modulus of the reinforcing member 3 is set larger than that of the midsole 2. Accordingly, the rigidity and strength of the shoe sole S is maintained and distortion of the midsole 2 is prevented.

FIG. 1(*c*) and FIG. 1(*d*) show the modified examples.

In the example shown in FIG. 1(*c*), protrusions 121, 131 are formed on a part of the first arch 2*c* and on a part of the second arch 3*c*, respectively, and the protrusions 121, 131 of the first and second arches 2*c*, 3*c* are in contact with each other. In this case, the protrusions 121 of the first arch 2*c* have relatively large compression deformation whereas the non-contact areas of both arches 2*c*, 3*c* deform independently from each other. Accordingly, in this example, the midsole 2 has the aforedescribed function of sinking down, i.e., deflects and compresses downward.

As shown in FIG. 1(*d*), a hole 23 is provided in the bottom surface 29 of the first arch 2*c* and a protrusion 33 engagable with the hole 23 is provided on the top surface 36 of the second arch 3*c*.

The fore and rear end parts 3*f*, 3*b* need not be sandwiched between the outer sole 1 and the midsole 2. As shown in FIG. 1(*c*) and FIG. 1(*d*), both end parts 3*f*, 3*b* may merely be attached or bonded to the outer sole 1.

Second Embodiment

Next, a second embodiment will be described with reference to FIG. 2, FIG. 3, FIG. 4 and FIG. 5. In the following description of embodiments, the parts which are identical or corresponding to those of the first embodiment are designated by the same reference numerals as the first embodiment and the detailed description and illustration thereof will be omitted.

Figure 2A:
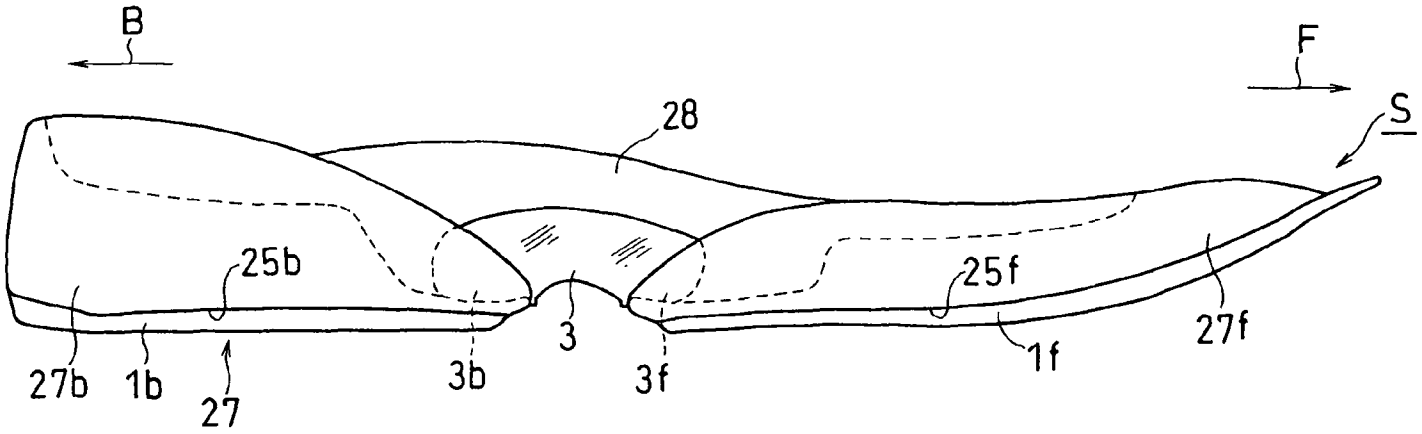
FIG. 2(*a*) is a side view of the shoe sole according to a second embodiment and FIG. 2(*b*) is a bottom view thereof.
Figure 2B:
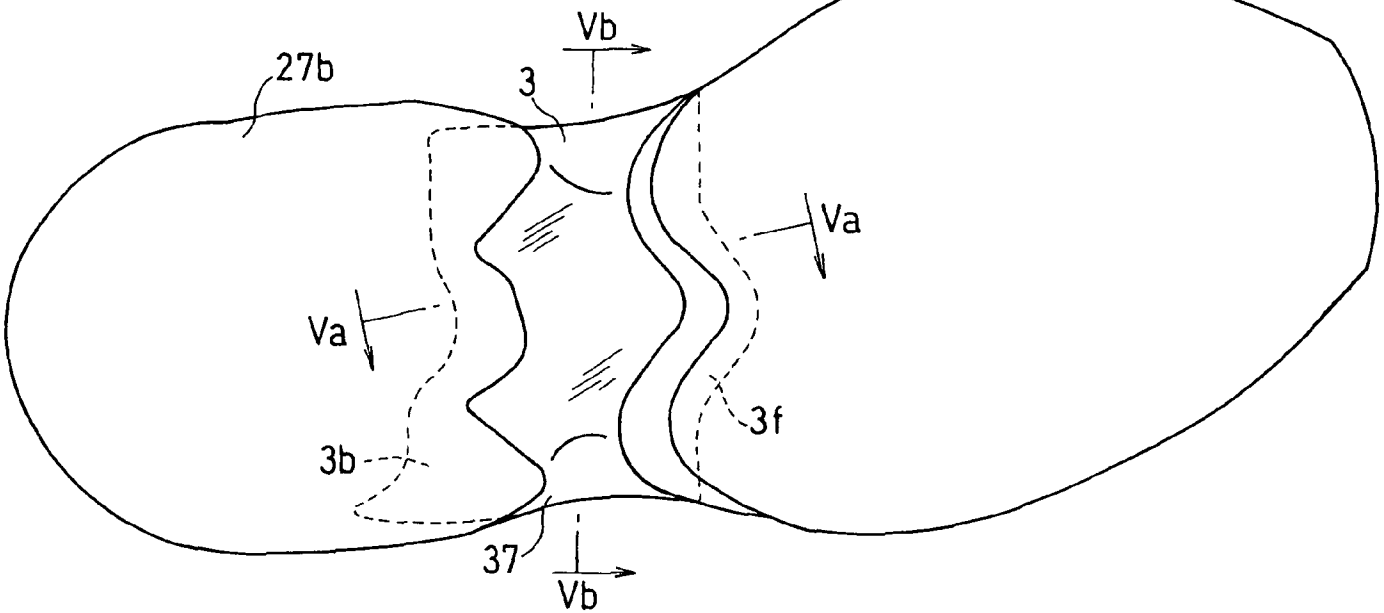

FIG. 2(*a*) is a side view showing the shoe sole S with an outer sole 1*f*, 1*b* attached. FIG. 2(*b*) is a bottom view showing the shoe sole S without the outer sole attached.

Figure 4:
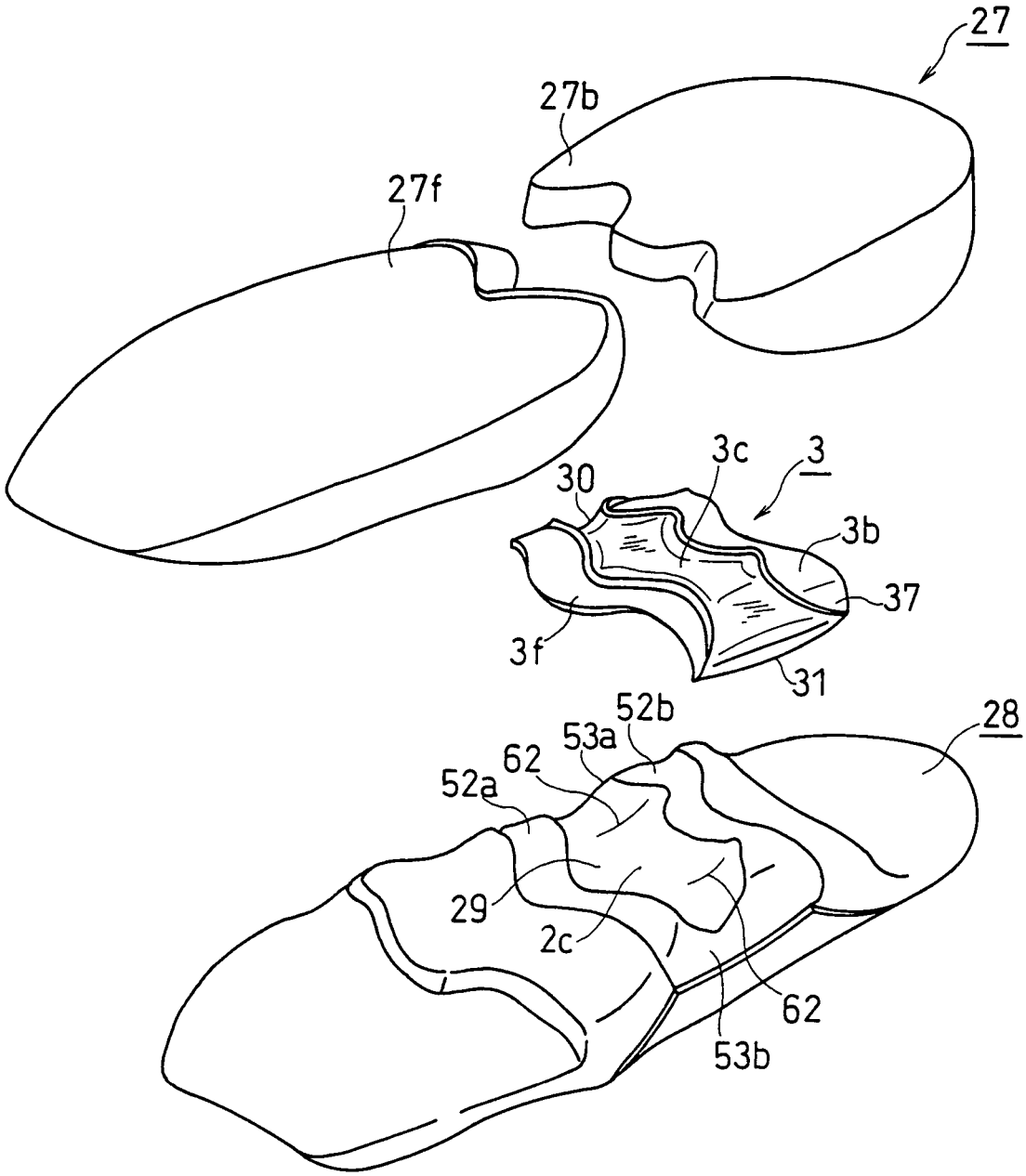
FIG. 4 is an exploded perspective view of parts of the shoe sole of FIGS. 2(*a*) and 2(*b*) from the bottom side.

As shown in FIG. 2(*a*), the shoe sole S comprises an upper midsole body 28, a lower midsole body 27 and a reinforcing member 3. In this embodiment, the upper and lower midsole bodies 28, 27 constitute the midsole 2. The lower midsole body 27 is divided at the position corresponding to the arch of the foot into a front part 27*f* and a rear part 27*b*. The fore foot part 1*f* of the outer sole 1 is attached to the bottom surface 25*f* of the front part 27*f* and the rear foot part 1*b* of the outer sole 1 is attached to the bottom surface 25*b* of the rear part 27*b*. As shown in FIG. 4, in the upper midsole body 28, the first arch 2*c* is provided at the position corresponding to the arch of the foot. In the reinforcing member 3, the second arch 3*c* is provided. The reinforcing member has a fore end part 3*f* in front of the second arch 3*c*, a rear end part 3*b* in the rear of the second arch 3*c*, a lateral side part 30 on the lateral side of the second arch 3*c* and a medial side part 31 on the medial side of the second arch 3*c*.

Figure 3:
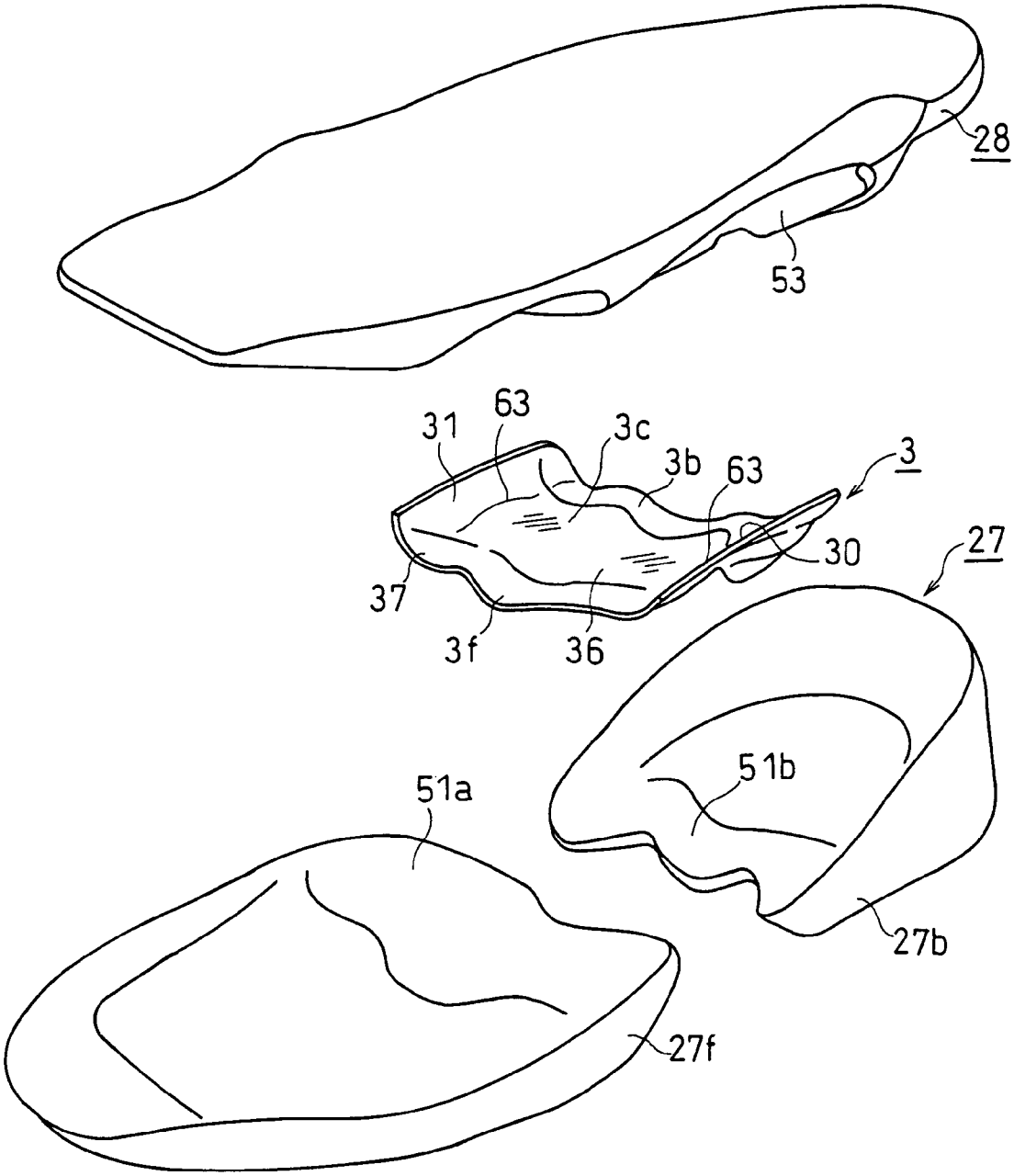
FIG. 3 is an exploded perspective view of parts of the shoe sole of FIGS. 2(*a*) and 2(*b*) from the top side.

Referring to FIG. 3, the lower midsole body 27, the upper midsole body 28 and the reinforcing member 3 are combined with each other. In this combination, the fore and rear end part 3*f*, 3*b* of the reinforcing member 3 are sandwiched in between the upper and lower midsole bodies 28, 27, and the medial and lateral side parts 31, 30 are joined to the upper midsole body 28. In the front part 27*f* and the rear part 27*b* of the lower midsole body 27, joining faces 51*a*, 51*b* are provided where the fore and rear end part 3*f*, 3*b* of the reinforcing member 3 are joined. Referring to FIG. 4, in the upper midsole body 28 joining faces 52*a*, 52*b* are provided where the fore and rear end part 3*f*, 3*b* of the reinforcing member 3 are joined and joining faces 53*a*, 53*b* are provided where the medial and lateral side parts 31, 30 are joined.

Figure 11:
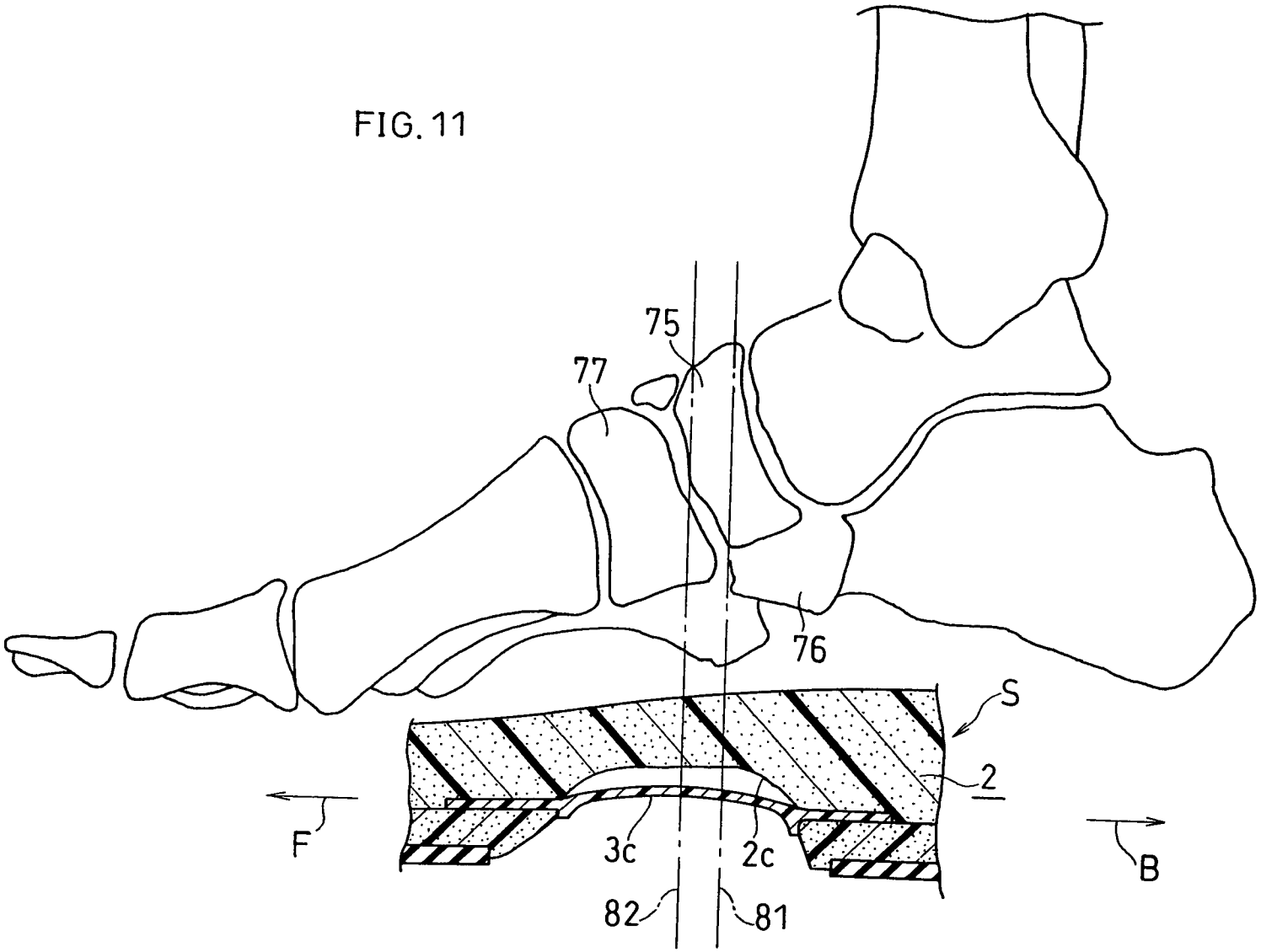
FIG. 11 is a longitudinal sectional view illustrating the relationship between the shoe sole of the present invention and foot bones.

As shown in FIG. 11, in the assembled shoe sole S, the first arch 2*c* and the second arch 3*c* are covered with the middle foot part of the foot. That is, the center line 82 of the first arch 2*c* of the midsole 2 and the second arch 3*c* of the reinforcing member 3 in the longitudinal direction is in proximity of the center line 81 of the arch of the foot in the longitudinal direction. For example the center line 82 may be located so as to pass through the navicular bone 75 and the cuneiform bone 77. Optionally, the center line 82 of the first arch 2*c* and the second arch 3*c* may be located so as to pass through the cuboid bone 76. Thus, there are a range of positions for the center line 82 with respect to the arch of the foot.

Figure 5:
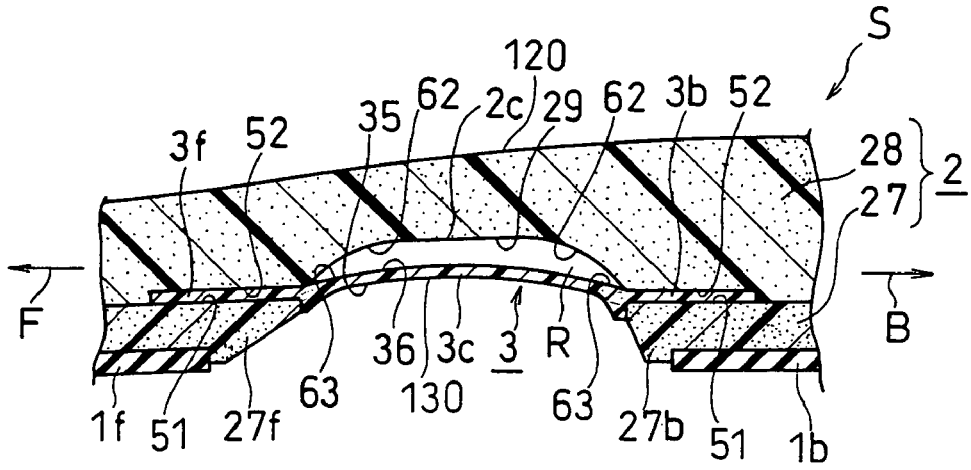
FIG. 5(*a*) is a sectional view taken along the line Va-Va of FIG. 2(*b*) and FIG. 5(*b*) is a sectional view taken along the line Vb-Vb of FIG. 2(*b*).
Figure 5B:
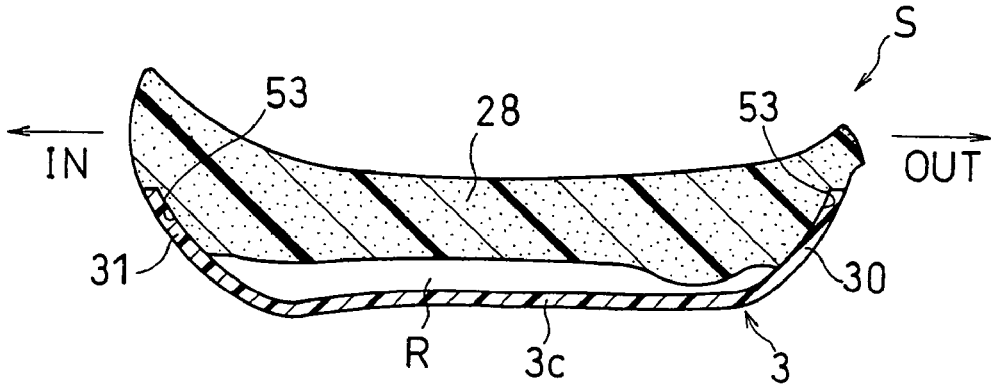

Further, as shown in sectional view FIG. 5(*a*), the bottom surface 29 of the first arch 2*c* and the top surface 36 of the second arch 3*c* are arranged so that they are opposite to each other and that they are vertically spaced from each other. Accordingly, when the foot lands on the ground, the upper midsole body 28 sinks down toward the second arch 3*c*, similarly to the first embodiment.

As shown in FIG. 4, on the bottom surface 29 of the first arch 2*c*, first curved surfaces 62, 62 which are concave in the circular arc shape are provided at the medial and lateral portions of the first arch 2*c*. As shown in FIG. 5(*a*), on the bottom surface 29 of the first arch 2*c*, such curved surfaces 62, 62 are also provided at the front and rear end portions of the first arch 2*c*. The central area of the bottom surface 29 of the first arch 2*c* is very gently curved or is substantially flat or planar.

As shown in FIG. 3, on the top surface 36 of the second arch 3*c*, second curved surfaces 63, 63 which are convex upwards in a circular arc shape are provided at the medial and lateral portions. As shown in FIG. 5(*a*), on the top surface 36 of the second arch 3*c*, such second curved surfaces 63, 63 are also provided at the front and rear end portions of the second arch 3*c*. The remaining area of the top surface 36 of the second arch 3*c* (for example, the central area) is very gently curved or is substantially flat or planar.

The first and second curved surfaces 62, 63 are formed approximately in the circular arc shape with a center line along the transverse direction as a center. The first and second curved surfaces 62, 63 are arranged so as to be opposite each other. That is, the two surfaces 62, 63 face opposed to each other.

Further, as shown in a sectional view of FIG. 5(*b*), the fore and rear end parts 3*f*, 3*b* of the reinforcing member 3 and lateral side part 30 and medial side part 31 of the reinforcing member 3 are joined to the upper midsole body 28. That is, entire of the peripheral edge of the reinforcing member is joined to the upper midsole body 28. Such a joint improves the functions of preventing the bend of the shoe and preventing the distortion of the shoe. That is, the bend and distortion of the shoe is prevented or minimized.

Such functions of preventing the bend of the shoe and preventing the distortion of the shoe will be explained.

The function of preventing the bend of the shoe, in view of the sectional shape, correlates with moment of inertia of area $I_y$ (second moment of inertia, geometrical moment of inertia) with respect to a neutral axis.

In this embodiment, since entire of the peripheral edge of the reinforcing member 3 is joined to the upper midsole body 28, the reinforcing member 3 integrally bends together with the upper midsole body 28. Thus, the moment of inertia of area $I_y$ increases by spacing the reinforcing member 3 away from the bottom surface of the upper midsole body 28.

Accordingly, the function of preventing the bend of the shoe is improved.

On the other hand, the function of preventing the distortion of the shoe, in view of the sectional shape, correlates with polar moment of inertia of area $I_p$ with respect to a centroid.

In this embodiment, since entire of the peripheral edge of the reinforcing member 3 is joined to the upper midsole body 28, the reinforcing member 3 is integrally distorted together with the upper midsole body 28. Thus, the polar moment of inertia of area $I_p$ increases by spacing the reinforcing member 3 away from the bottom surface of the upper midsole body 28.

Accordingly, the function of preventing the distortion of the shoe is improved.

Further, referring to FIGS. 3 and 4, by joining the entire peripheral edge 37 of the reinforcing member 3 to the upper midsole body 28, a sealed or closed space (domain) R is formed between the upper midsole body 28 and the reinforcing member 3 (see FIG. 5(*a*)). That is, the bottom surface 29 of the first arch 2*c* of the upper midsole body 28 and the top surface 36 of the second arch 3*c* of the reinforcing member 3 define the sealed or closed domain R. In such joint structure that encompasses the entire peripheral edge 37 of the reinforcing member 3, the air confined in the domain R supports the first arch 2*c* softly, thereby to prevent the first arch 2*c* of the upper midsole body 28 from sinking down too much.

Each of the upper and lower midsole bodies 28, 27 is preferably made of a foamed ethylene-vinyl acetate copolymer (EVA). However, the upper and lower midsole bodies 28, 27 may be made of a foam of another type resin. It is preferred that both upper and lower midsole bodies 28, 27 be made of the same material in order to improve the adhesiveness between the upper and lower midsole bodies 28, 27 so that they can support the reinforcing member 3 in a stable manner.

The reinforcing member 3 may be made of a non-foam of polyurethane, or may be made of foam or non-foam of other resin. Examples of resin materials that can be used to make the reinforcing member 3, are nylon, fiber reinforced plastic (FRP), carbon fiber reinforced plastic (CFRP), polyamide, polyester, polypropylene, polyvinyl chloride (PVC), acrylonitrile-butadiene-stylene (ABS), styrene. It is preferred that a non-foam resin, which has certain strength and is easy to mould, is used as the material for the reinforcing member 3. In addition, when the reinforced member 3 is formed of transparent resin, the quality of the design of the shoe is improved. A preferred transparent resin that may be used is a non-foam polyurethane or EVA, which can readily adhere to foamed EVA, the main material of the midsole.

The midsole 2 in this embodiment is divided to the upper and lower midsole bodies 28, 27, but the midsole 2 need not necessarily be so divided. The midsole 2 may be formed integrally, i.e. an integral one-piece unit. The shoe sole may be assembled with a shock absorbing material, such as gel, enclosed within the midsole 2.

Referring to FIG. 4, the first curved surface 62 of the first arch 2*c* is provided at both the medial portion and the lateral portion of the first arch 2*c*, but the first curved surface 62 may be provided at either the medial portion or the lateral portion of the first arch 2*c* or may be provided continuously from the medial portion to the lateral portion of the first arch 2*c*. The second curved surface 63 of the second arch 3*c* can be provided in a similar way to the first arch 2*c*.

Third Embodiment

Figure 6:
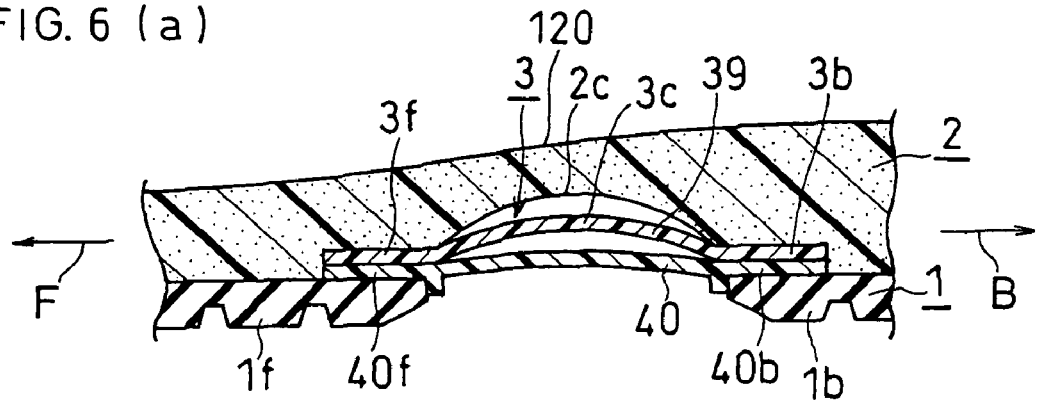
FIG. 6(*a*) is a longitudinal sectional view of the shoe sole according to a third embodiment, and FIG. 6(*b*) and FIG. 6(*c*) are longitudinal sectional views of modified examples of the same shoe sole.
Figure 6:
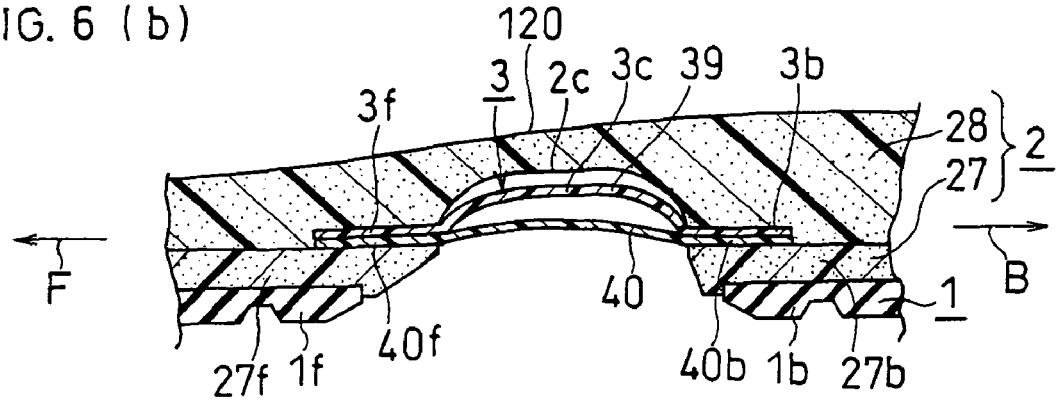
Figure 6:
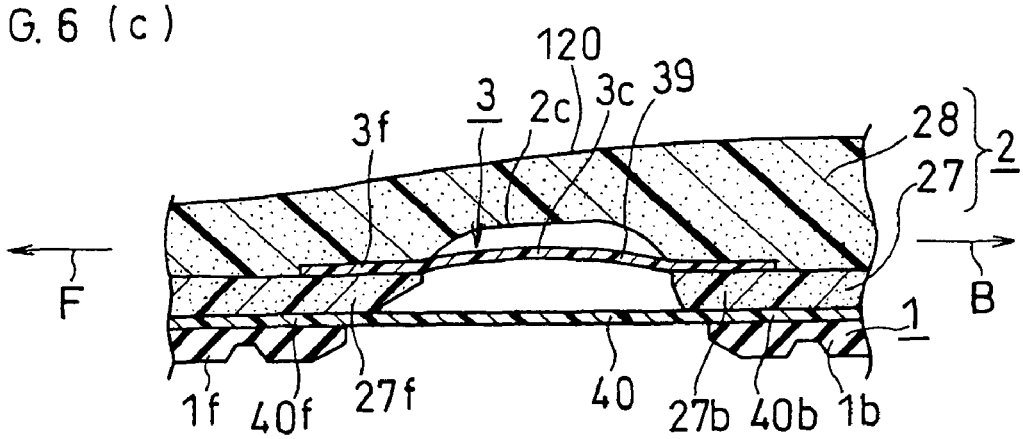

FIG. 6(*a*) is a longitudinal sectional view of a shoe sole according to a third embodiment.

As shown in FIG. 6(*a*), a first reinforcing member 39 and a second reinforcing member 40 are provided. The second reinforcing member 40 is a different member from the first reinforcing member 39. The second reinforcing member 40 is located below the first reinforcing member 39.

The first reinforcing member 39 corresponds to the reinforcing member 3 according to the above-mentioned first and second embodiments and has the second arch 3*c*. The second arch 3*c* is arranged to be opposite to the first arch 2*c* of the midsole 2 and to be vertically spaced from the first arch 2*c*.

On the other hand, the second reinforcing member 40 is for reinforcing the first reinforcing member 39. Such second reinforcing member 40 further prevents the distortion of the shoe sole at the arch of the foot.

In the example of FIG. 6(*a*), a fore end part 40*f* and a rear end part 40*b* of the second reinforcing member 40 are sandwiched in between the midsole 2 and the outer sole 1. Optionally, as shown in FIG. 6(*b*), the fore and rear end parts 40*f*, 40*b* may be sandwiched in between the lower midsole body 27 and the upper midsole body 28, or, as shown in FIG. 6(*c*), may be sandwiched between the lower midsole body 27 and the outer sole 1.

The second reinforcing member 40 is curved, similarly to the first reinforcing member 39, below the second arch 3*c* of the first reinforcing member 39, or may be substantially flat as shown in FIG. 6(*c*).

The Young's modulus of the second reinforcing member 40 may be set different from that of the first reinforcing member 39. It is preferable that Young's modulus of the second reinforcing member 40 is set approximately equal to that of the first reinforcing member 39 or that the Young's modulus of the first reinforcing member 39 is set smaller than that of the second reinforcing member 40.

Fourth Embodiment

Figure 7:
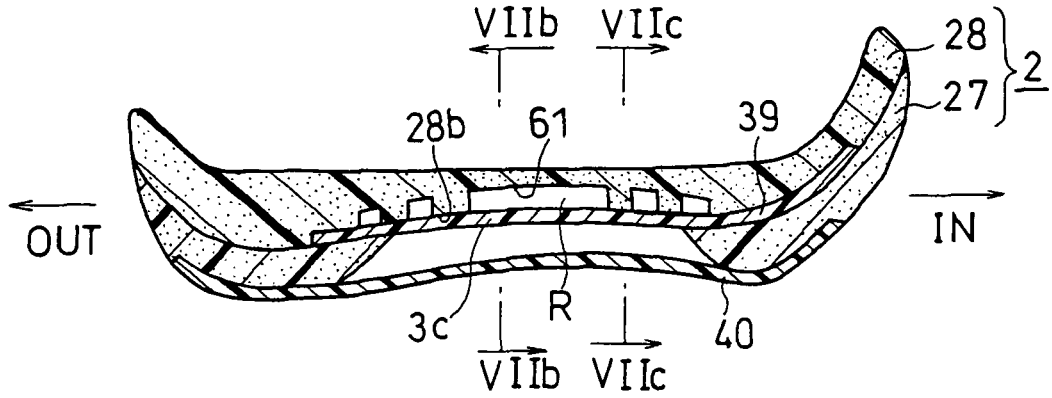
FIG. 7(*a*) is a transverse sectional view of the shoe sole according to a fourth embodiment, FIG. 7(*b*) is a sectional view taken along the line VIIb-VIIb of FIG. 7(*a*), and FIG. 7(*c*) is a sectional view taken along the line VIIc-VIIc of FIG. 7(*a*).
Figure 7:
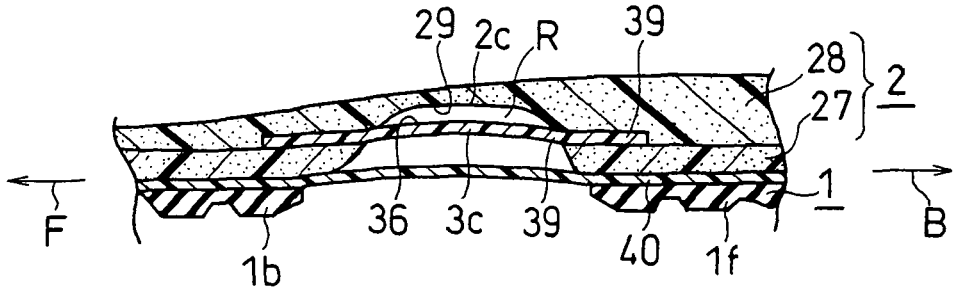
Figure 7:
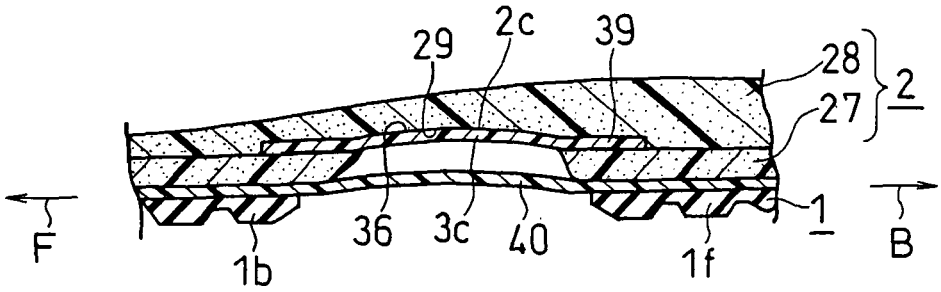

FIG. 7(*a*), FIG. 7(*b*) and FIG. 7(*c*) is sectional views of a shoe sole according to a fourth embodiment.

As shown in the transverse sectional view of FIG. 7(*a*), the first reinforcing member 39 is attached to a bottom surface 28*b* of the upper midsole body 28 and belt-like grooves 61 which extend approximately along the lengthwise direction of the shoe are formed on the bottom surface 28*b* of the upper midsole body 28. At the positions where the grooves 61 are formed, as shown in the longitudinal sectional view of FIG. 7(*b*), the bottom surface 29 of the first arch 2*c* and the top surface of the second arch 3*c* are vertically spaced from each other so that hollow portions R are formed. Accordingly, at the positions where the grooves 61 are formed (for example, the position indicated by the line VIIb-VIIb of FIG. 7(*a*)), the upper midsole body 28 can sink down similarly to the above-mentioned embodiments. On the contrary, at the positions where the grooves is not formed (for example, the position indicated by the line VIIc-VIIc of FIG. 7(*a*)), as shown in the longitudinal sectional view of FIG. 7(*c*), the top surface 36 of the second arch 3*c* is in contact with the bottom surface 29 of the first arch 2*c*.

Fifth Embodiment

Figure 12A:
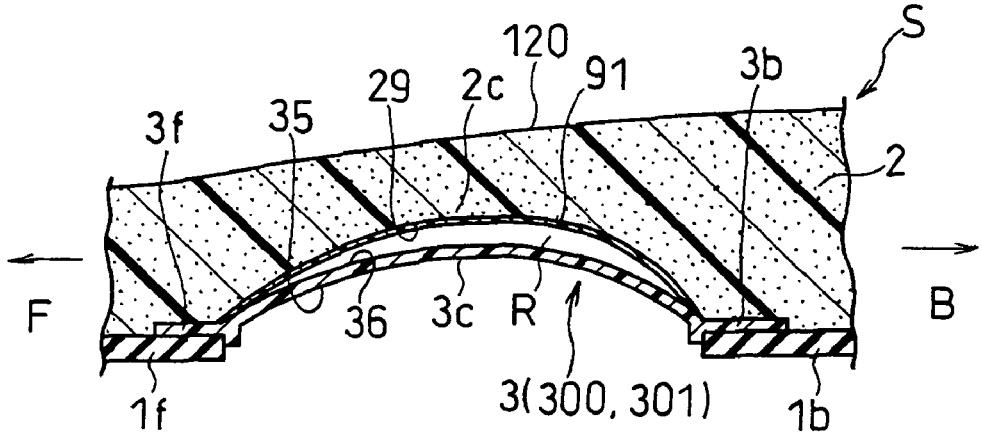
FIG. 12(*a*) is a longitudinal sectional view of the shoe sole according to a fifth embodiment, and FIG. 12(*b*) is a transverse sectional view thereof.
Figure 12B:
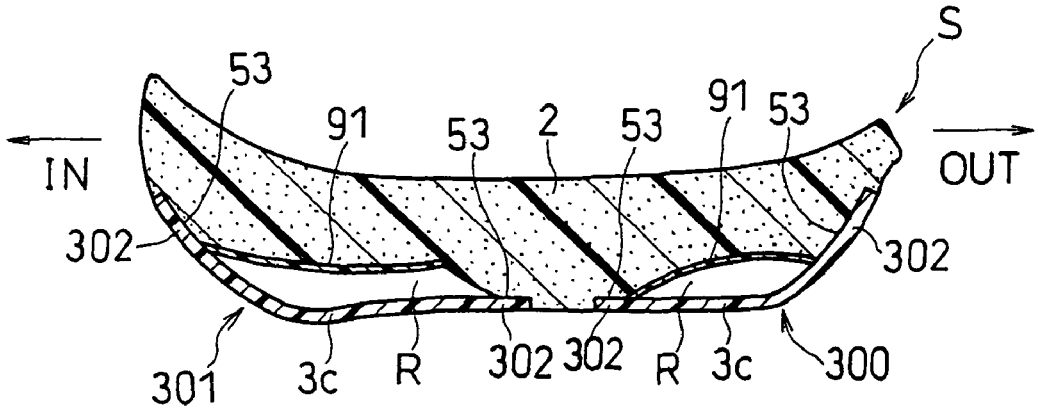

FIG. 12(*a*) and FIG. 12(*b*) are sectional views of a shoe sole according to a fifth embodiment.

As shown in a longitudinal sectional view of FIG. 12(*a*), a film-like member 91 is laminated and fixed onto the bottom surface 29 of the first arch 2*c* of the midsole 2. Thus, the bottom surface 29 of the first arch is reinforced, and so the bottom surface 29 of the first arch 2*c* is prevented from sinking down too much. Accordingly it becomes possible to form the first arch 2*c* of the midsole thinner. The film-like member is formed to be thinner than the second arch 3*c* of the reinforcing member 3.

In this embodiment, in order to obtain a desirable function of suppressing "upthrust" with the bottom surface 29 of the first arch 2*c* sinking down, the rigidity ratio of the film-like member 91 and the reinforcing member 3 is preferably set within a certain range. That is, a ratio of a product of multiplication between the average thickness $T_{91}$ and the Young's modulus $E_{91}$ of the film-like member 91 to a product of multiplication between the average thickness $T_{3c}$ and the Young's modulus $E_{3c}$ of the second arch 3*c* is set approximately ¼ or less (i.e. $T_{91} \cdot E_{91}/(T_{3c} \cdot E_{3c}) \leqq$ about ¼). It is speculated that the ratio is preferably set approximately ⅙ or less and that the ratio is more preferably set approximately 1/10 or less.

Further, it is preferred that the ratio is set at least approximately 1/1000 or more, and it is more preferred that the ratio is set approximately 1/100 or more. Such setting allows the film-like member 91 to have a certain rigidity, thereby to prevent the bottom surface of the first arch 2*c* from sinking down too much The thickness of the film-like member is set, for example, within a range of approximately 0.01 mm to 0.2 mm. The thickness of the second arch 3*c* is preferably set approximately 1.0 mm or more, and more preferably set within a range of approximately 1.5 mm to 3.0 mm.

In this embodiment, as shown in a transverse sectional view of FIG. 12(*b*), the first arch 2*c* and the reinforcing member 3 are divided into two in the transverse direction of the foot, respectively. A lateral side reinforcing member 300 and a medial side reinforcing member 301 have two side parts 302, 302, respectively. Each of the two side parts 302, 302 is joined to the midsole 2, and two closed domains R, R are formed, one in a medial direction and the other in a lateral direction of the foot.

Figure 8:
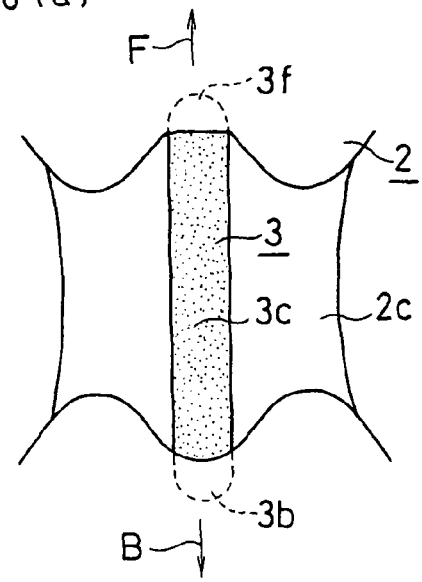
FIG. 8(*a*), FIG. 8(*b*), FIG. 8(*c*) and FIG. 8(*d*) are bottom views of different configurations for the reinforcing member.
Figure 8:
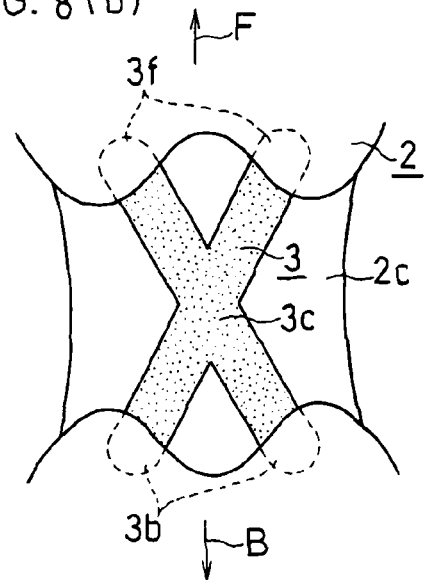
Figure 8:
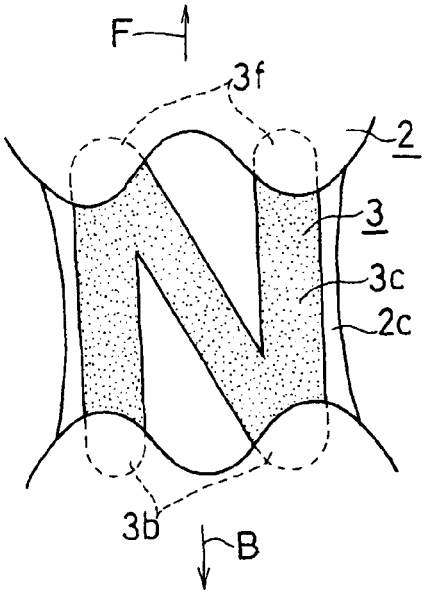
Figure 8:
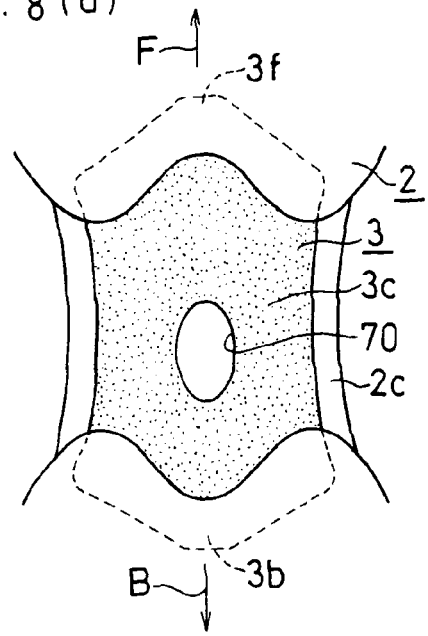
Figure 9A:
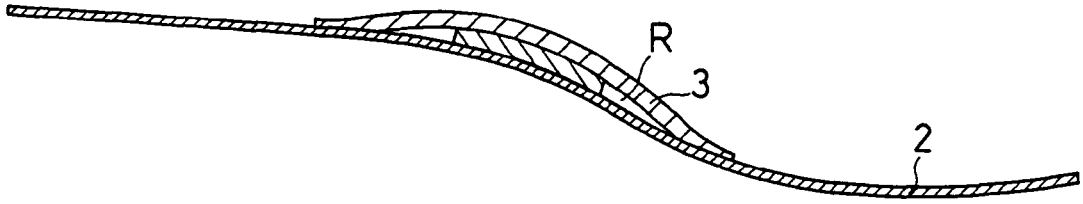
FIG. 9(a) PRIOR ART
FIG. 9(*a*) and FIG. 9(*b*) each illustrate a known shoe sole, with FIG. 9(*a*) being a longitudinal sectional view of one known shoe sole and FIG. 9(*b*) being a bottom view of another known shoe sole.
Figure 9B:
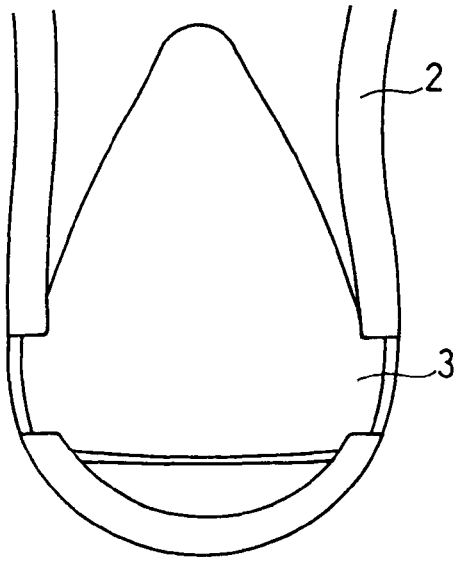
FIG. 9(b) PRIOR ART

FIG. 8(*a*), FIG. 8(*b*), FIG. 8(*c*) and FIG. 8(*d*) are bottom views of the shoe soles at the first arch of the midsole and show different configurations of the reinforcing member 3.

In the above mentioned second embodiment, the reinforcing member 3 covers all of the first arch 2*c*. However, the reinforcing member 3 need not always be in such shape. The reinforcing member 3 may be in any shape in which a part of the reinforcing member 3 can be joined to the midsole or the outer sole. Accordingly, the planar shape of the reinforcing member 3 may be formed into, for example, an approximately "I"-shaped planar shape as shown in FIG. 8(*a*), an approximately "X"-shaped planar shape as shown in FIG. 8(*b*) or an approximately "N"-shaped planar shape as shown in FIG. 8(*c*). Further, as shown in FIG. 8(*d*), the reinforcing member 3 may be formed so as to have an opening 70 vertically passing through the second arch 3*c* in the center of the reinforcing member 3.

Although the invention has been described hereinbefore in connection with its preferred embodiments with reference to the accompanying drawings, those skilled in the art could easily imagine various modifications and corrections within the scope of apparent range in view of the description thus far made.

For example, the reinforcing member which is provided with the shoe sole may be divided into a medial piece and a lateral piece, or the reinforcing member may be provided with only either the medial side of the foot or the lateral side of the foot. A foam or a filler which has a smaller Young's modulus than the midsole and which is capable of varying its volume may be fitted in the domain between the first arch and the second arch.

Therefore, such modifications and corrections should be interpreted to fall within the scope of the invention, as defined by the following claims.

INDUSTRIAL APPLICABILITY

The present invention is applicable to various athletic shoes, in addition to running shoes.

The invention claimed is:

1. A shoe sole with reinforcing structure for an arch of a foot, comprising:

an outer sole;

a midsole attached to a top surface of the outer sole; and a reinforcing member for reinforcing an arch portion of the midsole, the arch portion covering the arch of the foot, wherein the midsole is formed of resin foam and has a first arch at a bottom portion of the arch portion of the midsole, the first arch has a bottom surface, the outer sole is substantially not attached to the first arch of the midsole, the reinforcing member has a second arch located at the arch portion of the midsole, a fore end part located in front of the second arch and a rear end part located in a rear of the second arch, the second arch has a top surface and a bottom surface, the fore end part of the reinforcing member is bonded to at least either the midsole or the outer sole, in front of the first arch, the rear end part of the reinforcing member is bonded to at least either the midsole or the outer sole, in a rear of the first arch, wherein a Young's modulus of the reinforcing member is set to be greater than a Young's modulus of the first arch of the midsole, no part of the reinforcing member, having a greater Young's modulus than the Young's modulus of the first arch is affixed to the bottom surface of the first arch, the reinforcing member is arranged so that portions of the top surface of the second arch and portions of the bottom surface of the first arch are spaced apart from each other with no intervening structure therebetween, and at least a part of the bottom surface of the first arch is not in contact with at least a part of the top surface of the second arch in vertically spaced relationship to each other, whereby non-contact areas of the first arch and the second arch are defined and the non-contact areas can be deformed independently from each other at the arch portion of the midsole when impact load of landing is applied.

2. A shoe sole with reinforcing structure for an arch of a foot, comprising:

an outer sole having a ground contact surface and a top surface opposite to the ground contact surface;

a midsole having a top surface and a bottom surface, the bottom surface being attached to the top surface of the outer sole and covering the top surface of the outer sole; and a reinforcing member for reinforcing an arch portion of the midsole, the arch portion covering the arch of the foot, wherein the midsole has a first arch at a bottom portion of the arch portion of the midsole, the first arch is formed of resin foam and has a bottom surface, the reinforcing member has a second arch located at the arch portion of the midsole, a fore end part located in front of the second arch and a rear end part located in a rear of the second arch, the second arch has a top surface and a bottom surface, the second arch is located so as to be covered with the first arch, the fore end part of the reinforcing member is bonded to at least either the midsole or the outer sole in front of the first arch, the rear end part of the reinforcing member is bonded to at least either the midsole or the outer sole in a rear of the first arch, the first arch and the second arch are substantially not attached to the top surface of the outer sole and do not have ground contact when the ground contact surface of the outer sole is grounded, wherein a Young's modulus of the second arch is set to be greater than a Young's modulus of the first arch, no part of the reinforcing member, having a Young's modulus greater than the Young's modulus of the first arch of the midsole, is affixed to the bottom surface of the first arch, the reinforcing member is arranged so that portions of the top surface of the second arch and portions of the bottom surface of the first arch are spaced apart from each other with no intervening structure therebetween, and at least a part of the bottom surface of the first arch is not in contact with a part of the top surface of the second arch in vertically spaced relationship to each other, whereby non-contact areas of the first arch and the second arch are defined and the non-contact areas can be deformed independently from each other at the arch portion of the midsole when impact load of landing is applied.

3. A shoe sole according to claim 2, wherein when impact load of landing is applied, downward displacement of the non-contact area of the bottom surface of the first arch is set to be larger than that of the non-contact area of the top surface of the second arch.

4. A shoe sole according to claim 2, wherein the reinforcing member has two side portions and the two side portions are bonded to the midsole.

5. A shoe sole according to claim 2, wherein the bottom surface of the first arch has a first curved surface which forms a concave surface and the top surface of the second arch has a second curved surface which is convex upwards.

6. A shoe sole according to claim 2, wherein the bottom surface of the first arch and the top surface of the second arch define a domain, and the domain is formed to be hollow.

7. A shoe sole according to claim 6, wherein entire of a peripheral edge of the reinforcing member is bonded to the midsole, thereby to seal the domain.

8. A shoe sole according to claim 6, wherein an opening passing through the second arch vertically is formed.

9. A shoe sole according to claim 2, wherein the bottom surface of the first arch and the top surface of the second arch define a domain, and the domain is filled with a filler which has a smaller Young's modulus than the midsole and which is capable of varying its volume.

10. A shoe sole according to claim 9, wherein entire of a peripheral edge of the reinforcing member is bonded to the midsole, thereby to seal the domain.

11. A shoe sole according to claim 2, wherein the first arch is formed of foam of ethylene-vinyl acetate copolymer, and the reinforcing member is formed of non-foam of polyurethane, or foam or non-foam of ethylene-vinyl acetate copolymer.

12. A shoe sole according to claim 2, wherein the reinforcing member further comprises medial and lateral side portions on the medial side and lateral side of a foot of the second arch, and the medial and lateral side portions of the reinforcing member are bonded to the midsole.

13. A shoe sole according to claim 2, wherein the outer sole is separated into a fore foot part and a rear foot part at a position corresponding to the arch of the foot, the fore foot part and the rear foot part of the outer sole each have a top surface and a bottom surface, the fore end part of the reinforcing member is sandwiched in between the top surface of the fore foot part of the outer sole and the bottom surface of the midsole, and the rear end part of the reinforcing member is sandwiched in between the top surface of the rear foot part of the outer sole and the bottom surface of the midsole.

14. A shoe sole according to claim 2, wherein the midsole includes an upper midsole body and a lower midsole body, the upper and lower midsole bodies are formed of an ethylene-vinyl acetate copolymer, and the reinforcing member is bonded to the upper and lower midsole bodies with both of the fore end part and the rear end part of the reinforcing member sandwiched in between the upper midsole body and the lower midsole body.

15. A shoe sole according to claim 2, wherein the reinforcing member constitutes a first reinforcing member, a second reinforcing member other than the first reinforcing member is provided, and the second reinforcing member is arranged below the first reinforcing member.

16. A shoe sole according to claim 2, wherein the center line of the first arch in the longitudinal direction and the center line of the second arch in the longitudinal direction are arranged at least just under a navicular bone, a cuboid bone or the cuneiform bone of the foot.

17. A shoe sole according to claim 2, wherein the first arch has a top surface, the top surface of the first arch has a curved surface which is convex upwards so as to be approximately along with the arch of the foot.

18. A shoe sole according to claim 2, wherein the bottom surface of the second arch has a curved surface which forms a concave surface recessed upwards.

19. A shoe sole comprising:

a midsole having a foot bearing surface and a bottom surface, the bottom surface including an arch portion and a remaining portion, the arch portion covering an arch of a foot, an outer sole having a ground contacting surface and a top surface, the outer sole being attached to the remaining portion of the bottom surface of the midsole, a first arch formed in the bottom surface of the midsole at the arch portion, a bottom surface of the first arch being concave downward, and a reinforcing member for the arch portion, the reinforcing member comprising:

a second arch, the first and second arches juxtaposed upon each other, the top surface of the second arch being convex upwards toward the bottom surface of the first arch, wherein portions of such top surface of the second arch and bottom surface of the first arch are in spaced apart relationship to each other with no intervening structure therebetween and such portions deform independently from each other upon application of an impact load to the sole, wherein the second arch has a Young's modulus greater than a Young's modulus of the first arch, and no part of the reinforcing member, having a greater Young's modulus than the Young's modulus of the first arch, is affixed to the bottom surface of the first arch.

* * * * *